US010463127B2

(12) United States Patent
Kim

(10) Patent No.: US 10,463,127 B2
(45) Date of Patent: Nov. 5, 2019

(54) CONTACT LENS PACKAGING CONTAINER

(71) Applicant: OPTIXON Inc., Daegu (KR)

(72) Inventor: Myoung-sam Kim, Daegu (KR)

(73) Assignee: OPTIXON INC., Daegu (KR)

( * ) Notice: Subject to any disclaimer, the term of this patent is extended or adjusted under 35 U.S.C. 154(b) by 0 days.

(21) Appl. No.: 15/750,559

(22) PCT Filed: Aug. 31, 2016

(86) PCT No.: PCT/KR2016/009731
§ 371 (c)(1),
(2) Date: Feb. 6, 2018

(87) PCT Pub. No.: WO2017/043804
PCT Pub. Date: Mar. 16, 2017

(65) Prior Publication Data

US 2019/0008251 A1 Jan. 10, 2019

(30) Foreign Application Priority Data

Sep. 11, 2015 (KR) ..... 10-2015-0129012

(51) Int. Cl.
*A45C 11/00* (2006.01)

(52) U.S. Cl.
CPC ..... *A45C 11/005* (2013.01)

(58) Field of Classification Search
CPC ..... A45C 11/005; A45C 11/04; A45C 11/046; A45C 2011/006
USPC ..... 206/5.1
See application file for complete search history.

(56) References Cited

U.S. PATENT DOCUMENTS 3,977,517 A * 8/1976 Kadlecik ..... A45C 11/005 206/5.1
5,474,169 A 12/1995 Bauman
5,722,536 A * 3/1998 Pierce ..... A45C 11/005 206/205
6,435,339 B1 * 8/2002 Kroupa ..... A45C 11/005 206/38
7,819,241 B2 * 10/2010 Post-Smith ..... A45C 11/005 206/5.1
7,938,255 B2 * 5/2011 Newman ..... A45C 11/005 206/5.1
8,833,548 B2 * 9/2014 Hsieh ..... A45C 11/046 206/5.1

(Continued)

FOREIGN PATENT DOCUMENTS

JP 2002-306227 A 10/2002
JP 5544051 B2 7/2014

*Primary Examiner* — Steven A. Reynolds
(74) *Attorney, Agent, or Firm* — Korus Patent, LLC; Seong Il Jeong

(57) ABSTRACT

The present invention relates to a contact lens packaging container. According to an embodiment of the present invention, an edge protection portion configured such that the peripheral zone of a contact lens is supported thereon in order to prevent the efficacy of the contact lens from being damaged and an optical zone protection portion configured such that the optical zone of the contact lens is supported in the state of having been pressed are formed on each accommodation portion of a body, thereby providing the advantageous effect of enabling contact lenses to be efficiently packaged in a narrow space and thus minimizing the size of the contact lens packaging container.

3 Claims, 4 Drawing Sheets

(56) References Cited

U.S. PATENT DOCUMENTS

| | | | | |
|---|---|---|---|---|
| 2006/0213784 | A1* | 9/2006 | Tokarski | B65D 81/22 206/5.1 |
| 2006/0219577 | A1* | 10/2006 | Newman | A45C 11/005 206/5.1 |
| 2009/0200182 | A1* | 8/2009 | Post-Smith | A45C 11/005 206/5.1 |
| 2012/0061260 | A1* | 3/2012 | Newman | A45C 11/005 206/5.1 |
| 2012/0220688 | A1* | 8/2012 | Wang | G02B 1/043 523/107 |
| 2013/0280142 | A1* | 10/2013 | Sturm | A61L 12/08 422/292 |
| 2015/0114851 | A1* | 4/2015 | English | B65D 75/326 206/5.1 |

* cited by examiner

CONTACT LENS PACKAGING CONTAINER

TECHNICAL FIELD

The present invention relates to a contact lens packaging container which is used to package contact lenses in order to prevent them from being damaged.

BACKGROUND ART

Generally, a contact lens is worn on a cornea present on the front surface of an eye, and is used for purposes, such as vision correction, eye treatment, beauty treatment, etc.

In this case, the contact lens is formed to have a size to the extent that it can cover a cornea so that there is no sense of resistance when it is worn and to have a considerably thin thickness, and is made of a semispherical soft material so that it can come into tight contact with a cornea.

Such a contact lens is manufactured to be suitable for the vision of a person who will use it, and is sealed inside a packaging container in which a contact lens solution is contained. A person who will use the contact lens removes the packaging foil of the sealed packaging container, and uses the accommodated contact lens.

In this case, in order to wear the contact lens, it is necessary to open the packaging foil of the packaging container and pick up the contact lens submerged in the contact lens solution with fingers or dedicated tongs. Accordingly, problems arise in that fingers are submerged in the contact lens solution, in that it is difficult to easily pick up the contact lens, and in that it is difficult to pick up the contact lens in a form which the contact lens can be easily worn.

With this point in view, as an example, Korean Patent Application Publication No. 10-2009-0050388 (published on May 20, 2009) discloses a soft lens packaging container which enables a lens, contained in the contact lens solution of the packaging container, to be taken out of the packaging container in the state of having been attached to the bottom of a cover when the cover is opened, thereby enabling the lens to be easily worn.

However, the conventional soft lens packaging container is problematic in that only a single contact lens is packaged therein, and is also problematic in that the soft lens packaging container is a few times larger than the contact lens, so that it is difficult to stack such soft lens packaging containers on each other and the soft lens packaging container is too bulky to carry.

The background art of the present invention is disclosed in Korean Patent Application Publication No. 10-2009-0050388 (published on May 20, 2009).

DISCLOSURE

Technical Problem

The present invention has been conceived based on the above-described background, and an object of the present invention is to provide a contact lens packaging container in which an edge protection portion configured such that the peripheral zone of a contact lens is supported thereon in order to prevent the efficacy of the contact lens from being damaged and an optical zone protection portion configured such that the optical zone of the contact lens is supported in the state of having been pressed are formed on each accommodation portion of a body, thereby enabling contact lenses to be efficiently packaged in a narrow space.

Another object of the present invention is to provide a contact lens packaging container in which a contact lens is packaged in each accommodation portion of a body in the state in which the optical zone of the contact lens has been pressed, thereby minimizing the size of the contact lens packaging container.

A further object of the present invention is to provide a contact lens packaging container, in which the front portion of a contact lens is located to be oriented toward an open direction when each packaging foil is opened, thereby enabling the contact lens to be picked up in a form in which the contract lens can be easily worn.

A further object of the present invention is to provide a contact lens packaging container in which accommodation portions are formed in the lower and lower portions of a body, respectively, and different contact lenses are individually packaged, thereby enabling a pair of contact lenses suitable for left and right eye visions to be conveniently carried.

Yet another object of the present invention is to provide a contact lens packaging container in which a finger support groove is formed on the outer circumferential surface of a body, thereby enabling packaging foils to be easily opened.

Technical Solution

In order to accomplish the above objects, an embodiment of the present invention provides a contact lens packaging container, including: a body in which a first accommodation portion configured to be filled with a contact lens solution and to be open upward, and a second accommodation portion configured to be filled with a contact lens solution and to be open downward.

Furthermore, in the present invention, the contact lens packaging container may further include: contact lenses configured such that the convex portion of each of the contact lenses is placed to be oriented toward an open direction in the state of having been submerged in the contact lens solution; a first packaging foil fusibly bonded to the upper end of the body so that the first accommodation portion of the body is sealed; and a second packaging foil fusibly bonded to the lower end of the body so that the second accommodation portion of the body is sealed.

Furthermore, in the present invention, the height of the first accommodation portion and second accommodation portion of the body may be famed to be lower than that of the contact lens, and thus the contact lens is accommodated in the state in which the optical zone thereof has been pressed.

Furthermore, in the present invention, an edge protection portion may be formed to protrude from any one side or each of both sides of the lower surface of the first accommodation portion and the upper surface of the second accommodation portion so that a peripheral zone of the contact lens can be supported thereon.

Furthermore, in the present invention, an optical zone protection portion may be famed to protrude from any one side or each of both sides of the lower surface of the first accommodation portion and the upper surface of the second accommodation portion so that the pressed optical zone of the contact lens can be supported thereon.

Furthermore, in the present invention, a finger support groove may be formed on the outer surface of the body in a concave form so that fingers are placed and supported on the finger support groove when the first packaging foil or second packaging foil is removed.

Furthermore, in the present invention, a grip portion may be formed on any one side or each of both sides of each of the first packaging foil and the second packaging foil so that the first packaging foil and the second packaging foil can be gripped.

Moreover, in the present invention, the thickness of the body may range from 2 to 6 mm.

Advantageous Effects

According to an embodiment of the present invention, the edge protection portion configured such that the peripheral zone of a contact lens is supported thereon in order to prevent the efficacy of the contact lens from being damaged and the optical zone protection portion configured such that the optical zone of the contact lens is supported in the state of having been pressed are formed on each accommodation portion of the body, thereby providing the advantageous effect of enabling contact lenses to be efficiently packaged in a narrow space.

Furthermore, a contact lens is packaged in each accommodation portion of the body in the state in which the optical zone of the contact lens has been pressed, thereby providing the advantageous effect of minimizing the size of the contact lens packaging container.

Furthermore, the front optical portion of a contact lens is located to be oriented toward an open direction when each packaging foil is opened, thereby providing the advantageous effect of enabling the contact lens to be picked up in a form in which the contract lens can be easily worn.

Furthermore, the accommodation portions are formed in the lower and lower portions of a body, respectively, and different contact lenses are individually packaged, thereby providing the advantageous effect of enabling a pair of contact lenses suitable for left and right eye visions to be conveniently carried.

Moreover, the finger support groove is formed on the outer circumferential surface of the body, thereby providing the advantageous effect of enabling the packaging foils to be easily opened.

DESCRIPTION OF REFERENCE SYMBOLS

Figure 1:
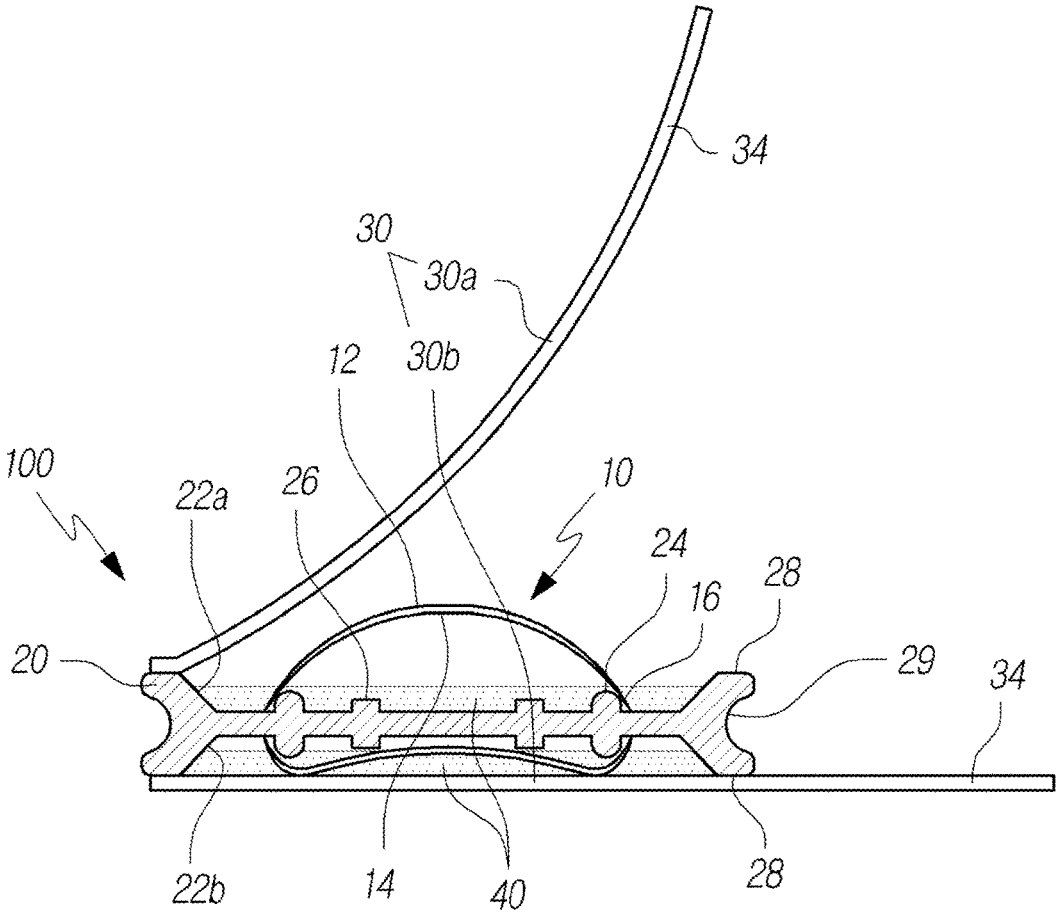
FIG. 1 is a side sectional view showing a contact lens packaging container according to an embodiment of the present invention.

20: body 22*a*: first accommodation portion
22*b*: second accommodation portion 24: edge protection portion
26: optical zone protection portion 28: flange portion
29: finger support groove 30*a*: first packaging foil
30*b*: second packaging foil 34: grip portion

MODE FOR INVENTION

Some embodiments of the present invention will be described in detail below via exemplary drawings. It should be noted that when reference symbols are assigned to the components of the drawings, the same reference symbols will be assigned to the same components as much as possible even when the components are shown in different drawings. Furthermore, in the description of the present invention, if a detailed description of a related well-known configuration or function is determined to make the gist of the present embodiment obscure, the detailed description will be omitted.

Furthermore, in the description of the components of the present invention, the terms "first," "second," "A," "B," "(a)," "(b)," etc. may be used to denote components of the present invention. Each of these terms is used merely to distinguish one component from another component, but does not denote the essence, sequential position, or the like of the corresponding component. Furthermore, when any component is described as "being connected to," "being combined with," or "being coupled to" another component, this does not exclude a third component, the former component may be directly connected to, combined with or coupled to the latter component, but still another component may be "connected," "combined," or "coupled" between the above components.

Figure 2:
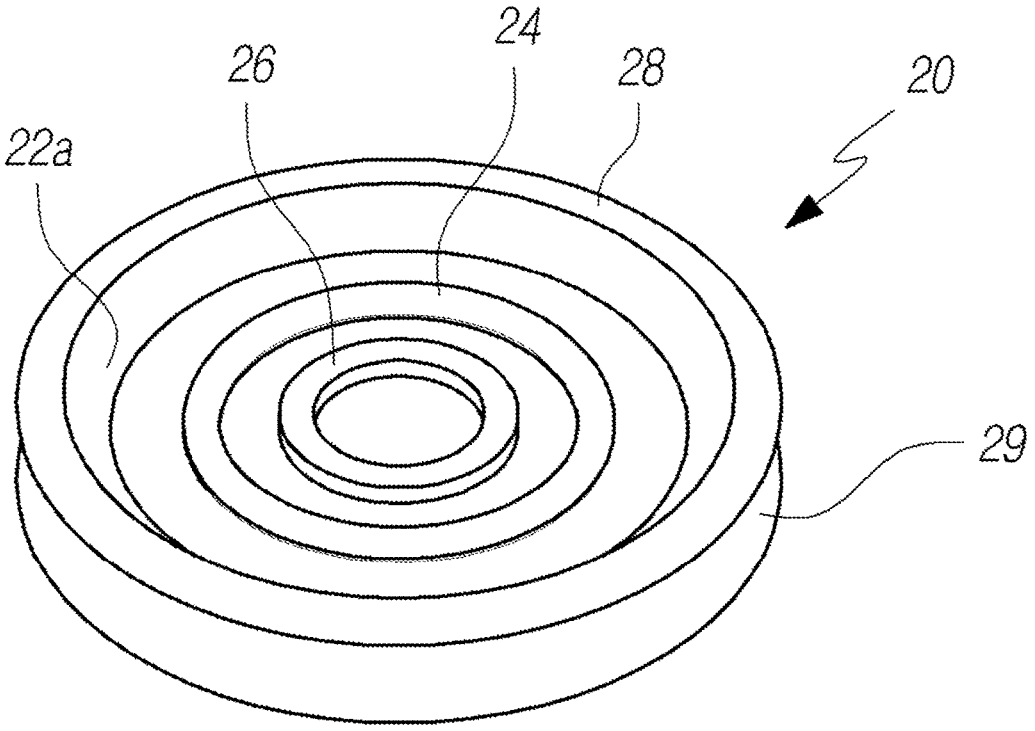
FIG. 2 is a perspective view showing the body of the contact lens packaging container according to the embodiment of the present invention.
Figure 3:
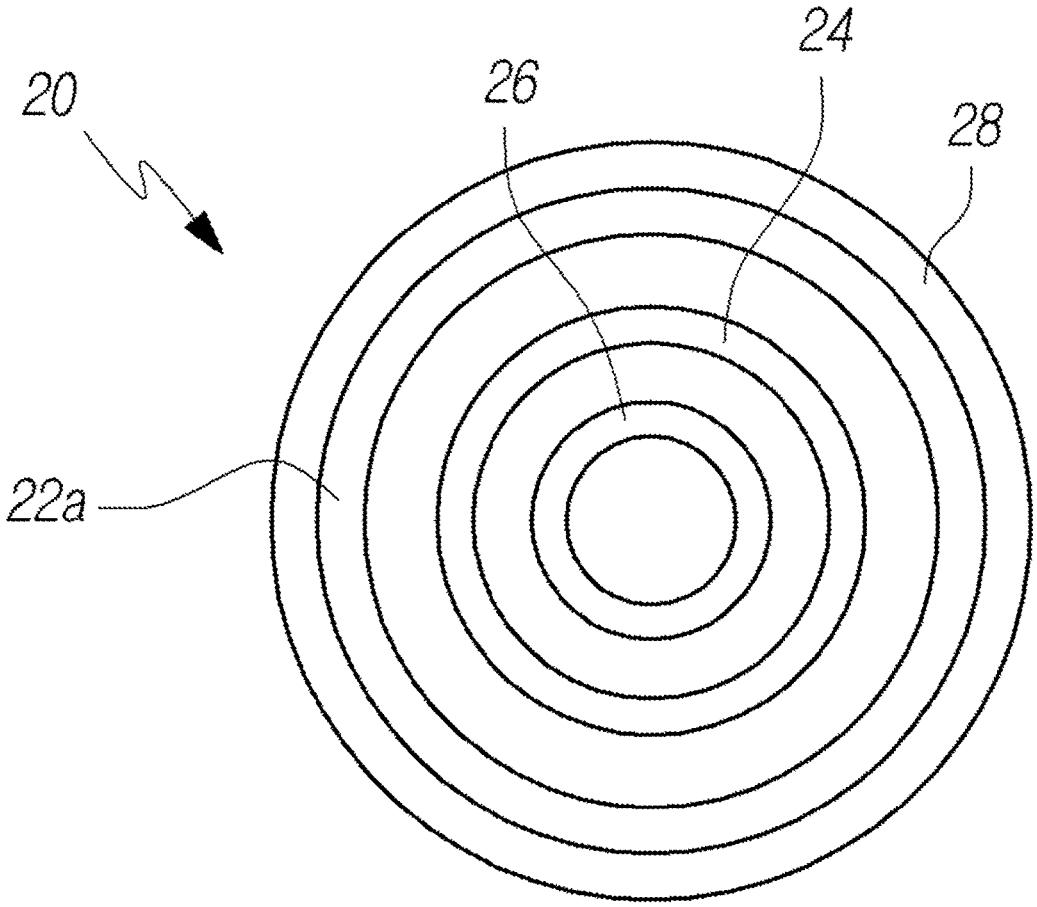
FIG. 3 is a plan view showing the body of the contact lens packaging container according to the embodiment of the present invention.
Figure 4:
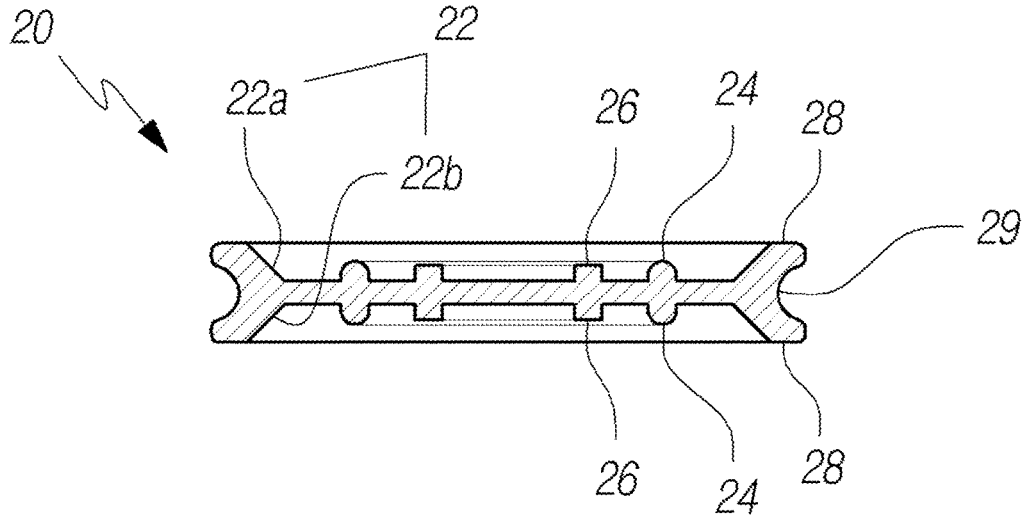
FIG. 4 is a side sectional view showing the body of the contact lens packaging container according to the embodiment of the present invention.
Figure 5:
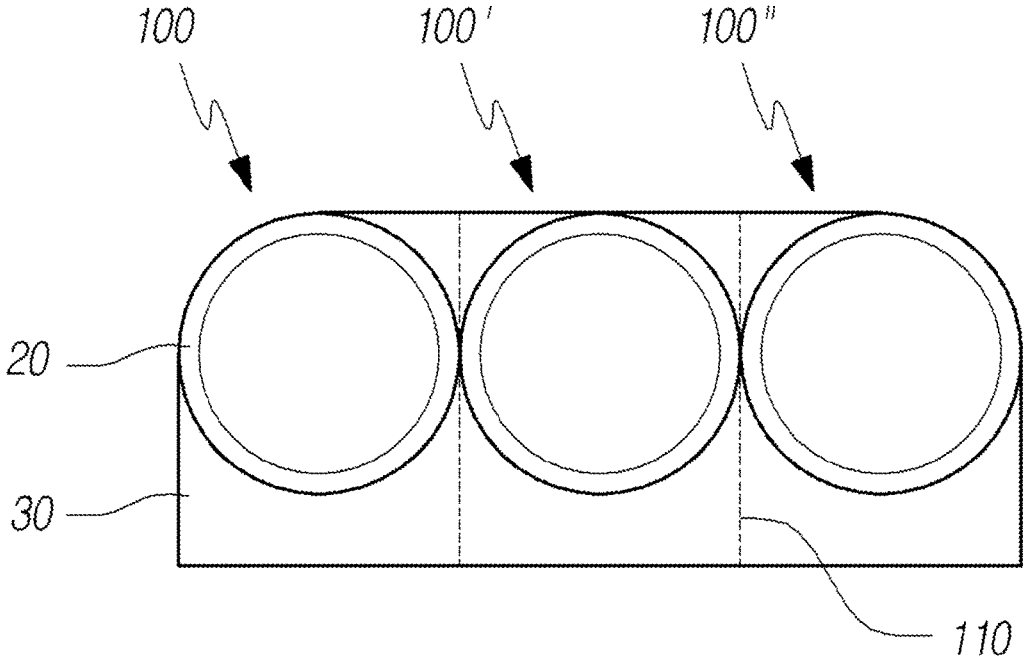
FIG. 5 is a view showing a state in which a plurality of contact lens packaging containers according to an embodiment of the present invention has been combined together.

FIG. 1 is a side sectional view showing a contact lens packaging container according to an embodiment of the present invention, FIG. 2 is a perspective view showing the body of the contact lens packaging container according to the embodiment of the present invention, FIG. 3 is a plan view showing the body of the contact lens packaging container according to the embodiment of the present invention, FIG. 4 is a side sectional view showing the body of the contact lens packaging container according to the embodiment of the present invention, and FIG. 5 is a view showing a state in which a plurality of contact lens packaging containers according to an embodiment of the present invention has been combined together.

As shown in the drawings, a contact lens packaging container 100 according to an embodiment of the present invention provides a contact lens packaging container 100, including: a body 20 configured such that a first accommodation portion 22*a* configured to be filled with a contact lens solution 40 and to be open upward and a second accommodation portion 22*b* configured to be filled with a contact lens solution 40 and to be open downward are formed therein; contact lenses 10 configured such that the convex portion of each of the contact lenses 10 is placed toward an open direction in the state in which the contact lens 10 has been submerged in the contact lens solution 40; a first packaging foil 30*a* fusibly bonded to the upper end of the body 20 so that the first accommodation portion 22*a* of the body 20 is sealed; and a second packaging foil 30*b* fusibly bonded to the lower end of the body 20 so that the body 20 of the second accommodation portion 22*b* is sealed.

The contact lens packaging container 100 according to the present invention is configured to include the contact lens 10, the body 20, the first packaging foil 30*a*, and the second packaging foil 30*b*.

The contact lens 10, the body 20, the first packaging foil 30*a*, and the second packaging foil 30*b* are described in detail below with reference to FIGS. 1 to 5.

The body 20 is made of a hard material, such as synthetic resin or the like, in order to prevent the body 20 from being damaged during transportation or storage. In the present invention, the body 20 is formed in an approximately cylindrical shape to have a thickness ranging from 2 to 6 mm.

The first accommodation portion 22*a* which is open upward and the second accommodation portion 22*b* which is open downward are formed in the body 20. Different contact lenses 10 are packaged in the first accommodation portion 22*a* and the second accommodation portion 22*b*, respectively, which are formed in the upper and lower portions of the body 20, respectively.

The different contact lenses 10 are packaged in the first accommodation portion 22*a* and the second accommodation portion 22*b*, respectively, and thus a pair of contact lenses 10 suitable for left and right eye visions can be conveniently carried.

The first accommodation portion 22*a* and the second accommodation portion 22*b* have structures which are symmetrical with respect to a horizontal plane. When viewed from above, the first accommodation portion 22*a* and the second accommodation portion 22*b* are formed in approximately circular shapes.

Furthermore, the first accommodation portion 22*a* and the second accommodation portion 22*b* are filled with the contact lens solutions 40, and the contact lenses 10 are placed in the state of having been submerged in the contact lens solutions 40.

In this case, the contact lens 10 is placed in each of the first accommodation portion 22*a* and the second accommodation portion 22*b* so that the convex portion thereof is oriented toward an open direction.

In other words, when the packaging foil 30 is opened, the front optical zone 12 of the contact lens 10 is placed to be oriented toward an open direction, and thus it is possible to pick up the contact lens 10 in an easily wearable form (in a form in which the convex portion of the contact lens comes into contact with an index finger).

In this case, the height of the first accommodation portion 22*a* and second accommodation portion 22*b* of the body 20 is formed to be lower than that of the contact lens 10. The contact lens 10 is accommodated and packaged in each of the first accommodation portion 22*a* and the second accommodation portion 22*b* in the state in which the optical zone 12 thereof has been pressed.

In this case, in order to prevent the efficacy of the contact lens 10 from being damaged, the peripheral zone 16 of the contact lens 10 is supported on the edge protection portion 24, and the surface 14 of the optical zone 12 which comes into tight contact with a cornea is supported on an optical zone protection portion 26.

The edge protection portion 24 is formed to protrude in a ring shape such that the peripheral zone 16 of the contact lens 10 is supported on each of the lower surface of the first accommodation portion 22*a* and the upper surface of the second accommodation portion 22*b*.

Furthermore, the optical zone protection portion 26 is formed to protrude in a ring shape such that the surface 14 of the pressed optical zone 12 of the contact lens 10 comes into contact with a cornea is supported on each of the lower surface of the first accommodation portion 22*a* and the upper surface of the second accommodation portion 22*b*.

In this case, the edge protection portion 24 and the optical zone protection portion 26 are concentric to each other, and the optical zone protection portion 26 is formed to be spaced apart inward from the edge protection portion 24 by a regular interval.

The edge protection portion 24 configured such that the peripheral zone of the contact lens 10 is supported thereon in order to prevent the efficacy of the contact lens 10 from being damaged and the optical zone protection portion 26 configured such that the optical zone 12 of the contact lens 10 is supported in the state of having been pressed are formed in each of the accommodation portions 22 of the body 20 as described above, and thus the contact lens 10 can be efficiently packaged within a small space.

Moreover, the contact lens 10 is packaged in each of the accommodation portions 22 of the body 20 in the state in which the optical zone 12 of the contact lens 10 has been pressed, and thus the size of the contact lens packaging container 100 can be minimized.

Next, the first packaging foil 30*a* is fusibly bonded to the upper end of the body 20 so that the first accommodation portion 22*a* of the body 20 is sealed, and the second packaging foil 30*b* is fusibly bonded to the lower end of the body 20 so that the second accommodation portion 22*b* of the body 20 is sealed.

In other words, the first packaging foil 30*a* seals the first accommodation portion 22*a* in order to prevent the contact lens solution 40, with which the first accommodation portion 22*a* of the body 20 is filled, from leaking, and is separably and fusibly bonded to a flange portion 28 which is formed to be flat at the upper end of the body 20 in a circumferential direction.

Furthermore, the second packaging foil 30*b* seals the second accommodation portion 22*b* in order to prevent the contact lens solution 40, with which the second accommodation portion 22*b* of the body 20 is filled, from leaking, and is separably and fusibly bonded to a flange portion 28 which is formed to be flat at the lower end of the body 20 in a circumferential direction.

In this case, sealing is performed in such a manner that the first packaging foil 30*a* and the second packaging foil 30*b* are primarily and thermally bonded to the flange portions 28 of the body 20 at a temperature ranging from 160 to 180° C., at a pressure ranging from 0.20 to 0.30 Mpa and for a time dwell time ranging from 2 to 4 seconds and the first packaging foil 30*a* and the second packaging foil 30*b* are secondarily and thermally bonded to the flange portions 28 of the body 20 at a temperature ranging from 190 to 210° C., at a pressure ranging from 0.20 to 0.30 Mpa, and for a time dwell time ranging from 2 to 5 seconds.

Alternatively, the first packaging foil 30*a* and the second packaging foil 30*b* may be bonded to the flange portions 28 of the body 20 by means of an adhesive or the like.

Next, when the contact lenses 10 sealed in the contact lens packaging container 100 are unpackaged, the packaging foils 30 are removed. In this case, a finger support groove 29 is formed on the outer surface of the body 20 such that when the packaging foils 30 are removed, fingers are placed in the finger support groove 29 and grip the body 20.

The finger support groove 29 is formed to be concave on the outer circumferential surface of the body 20 in a circumferential direction. In the state in which fingers have been placed on the finger support groove 29 and have gripped the body 20, the first packaging foil 30*a* or second packaging foil 30*b* is removed.

The finger support groove 29 is formed on the outer circumferential surface of the body 20 as described above, and the packaging foils 30 can be opened more easily.

In addition, a grip portion 34 may be formed on one side or each of both sides of each of the first packaging foil 30*a* and the second packaging foil 30*b* in order to facilitate the removal thereof.

In other words, one side of each of the packaging foils 30 which cover the body 20 is extended in a widthwise direction and forms the grip portion 34.

Accordingly, when the first packaging foil 30*a* or second packaging foil 30*b* is removed, the first packaging foil 30*a* or second packaging foil 30*b* is removed by pulling the grip portion 34 of the first packaging foil 30*a* or second packaging foil 30*b* in the state in which fingers have been placed on the finger support groove 29 and have gripped the body 20.

As shown in FIG. 6, the packaging foils 30 of the contact lens packaging container 100 may be integrated with the packaging foils 30 of adjacent contact lens packaging containers 100' and 100". In order to enable the contact lens packaging containers 100, 100' and 100" to be separated from each other, cutoff lines 110 may be formed on the portions of the packaging foil 30 between the contact lens packaging containers 100, 100' and 100".

Next, a method of performing packaging by means of and making use of the contact lens packaging container 100 according to the present invention is described.

First, the first accommodation portion 22*a* of the body 20 is filled with the contact lens solution 40.

Furthermore, the contact lens 10 is put into the first accommodation portion 22*a* such that the convex portion of the contact lens 10 is oriented toward an open direction.

In this case, the peripheral zone 16 of the contact lens 10 is supported on the edge protection portion 24 of the first accommodation portion 22*a*.

Furthermore, the first packaging foil 30*a* is fusibly bonded to the upper end of the body 20 such that the first accommodation portion 22*a* of the body 20 is sealed.

According to the present invention, the height of the first accommodation portion 22*a* of the body 20 is formed to be lower than that of the contact lens 10, and thus the contact lens 10 is accommodated and packaged in the first accommodation portion 22*a* of the body 20 in the state in which the optical zone 12 of the contact lens 10 has been pressed.

In other words, in order to prevent the efficacy of the contact lens 10 from being damaged, the contact lens 10 is packaged in the state in which the peripheral zone 16 of the contact lens 10 has been supported on the edge protection portion 24 and the surface 14 of the optical zone 12 which comes into tight contact with a cornea has been supported on the optical zone protection portion 26.

Thereafter, the second accommodation portion 22*b* of the body 20 is filled with the contact lens solution 40.

Furthermore, the contact lens 10 is put into the second accommodation portion 22*b* so that the convex portion of the contact lens 10 is oriented toward an open direction.

In this case, the peripheral zone 16 of the contact lens 10 is supported on the edge protection portion 24 of the second accommodation portion 22*b*.

Furthermore, the second packaging foil 30*b* is fusibly bonded to the upper end of the body 20 such that the second accommodation portion 22*b* of the body 20 is sealed.

According to the present invention, the height of the second accommodation portion 22*b* of the body 20 is formed to be lower than that of the contact lens 10, and thus the contact lens 10 is accommodated and packaged in the second accommodation portion 22*b* of the body 20 in the state in which the optical zone 12 of the contact lens 10 has been pressed.

In other words, in order to prevent the efficacy of the contact lens 10 from being damaged, the contact lens 10 is packaged in the state in which the peripheral zone 16 of the contact lens 10 has been supported on the edge protection portion 24 and the surface 14 of the optical zone 12 which comes into tight contact with a cornea has been supported on the optical zone protection portion 26.

Next, when the contact lens 10 sealed in the contact lens packaging container 100 is taken out of the contact lens container 100, the first packaging foil 30*a* or second packaging foil 30*b* is removed by pulling the grip portion 34 of the first packaging foil 30*a* or second packaging foil 30*b* in the state in which fingers have been placed on the finger support groove 29 and have gripped the body 20.

In this case, when the contact lens packaging container 100 is opened by removing the packaging foil 30, the front optical zone 12 of the contact lens 10 is located to be oriented upward. Accordingly, it is possible to pick up the contact lens 10 in a form in which the contact lens 10 can be easily worn, i.e., in a form in which the convex portion of the contact lens 10 comes into contact with an index finger.

Although the above description illustrates that all the components constituting the embodiments of the present invention are combined into one or are combined into one and operated, the present invention is not limited to the embodiments. That is, within the range of the objects of the present invention, all the components may be selectively combined into at least one and operated.

Furthermore, unless specifically stated otherwise, the terms "include," "comprise," "have," and their conjugates mean the inclusion of corresponding components. These terms should not be each interpreted as excluding another component, but should be each interpreted as further including another component. Unless defined otherwise, all terms, including technical or scientific terms, have the same meanings as commonly understood by those skilled in the art to which the present invention pertains. Commonly used terms, such as those defined in dictionaries, should be interpreted as having meanings consistent with their meanings in the context of relevant art, and should not be interpreted in an idealized or overly formal sense unless expressly so defined herein.

The above description is intended merely to illustrate the technical spirit of the present invention. It will be apparent to those having ordinary knowledge in the art to which the present invention pertains that various modifications and alterations are possible without departing from the essential features of the present invention. Accordingly, the embodiments disclosed herein are not intended to limit the technical spirit of the present invention, but are intended to illustrate the technical spirit of the present invention. The scope of the technical spirit of the present invention is not limited by these embodiments and the accompanying drawings. The range of protection of the present invention should be defined based on the attached claims, and all technical spirits falling within a range equivalent to the claims should be construed as being included in the range of rights of the present invention.

The invention claimed is:

1. A contact lens packaging container, comprising:

a body having a first accommodation portion configured to be filled with a contact lens solution and to be open upward, and a second accommodation portion configured to be filled with a contact lens solution and to be open downward, the first accommodation portion and the second accommodation portion having structures which are symmetrical with respect to a horizontal plane;

contact lenses configured such that a convex portion of each of the contact lenses is placed to be oriented toward an open direction in a state of having been submerged in the contact lens solution;

a first packaging foil configured to be fusibly bonded to an upper end of the body so that the first accommodation portion of the body is sealed; and a second packaging foil configured to be fusibly bonded to a lower end of the body so that the second accommodation portion of the body is sealed, wherein an edge protection portion is formed to protrude in a ring shape from any one side or each of both sides of a lower surface of the first accommodation portion and an upper surface of the second accommodation portion so that a peripheral zone of the contact lens can be supported thereon, wherein a finger support groove is formed on an outer circumferential surface of the body in a concave form so that fingers are placed and supported on the finger support groove when the first packaging foil or the second packaging foil is removed, wherein a height of the first accommodation portion and second accommodation portion of the body is formed to be smaller than that of the contact lens, and thus the contact lens is accommodated in a state in which an optical zone thereof has been pressed, and wherein an optical zone protection portion concentrically disposed within the edge protection portion is formed to protrude from the any one side or each of the both sides of the lower surface of the first accommodation portion and the upper surface of the second accommodation portion so that the pressed optical zone of the contact lens can be supported thereon.

2. The contact lens packaging container of claim 1, wherein a grip portion is formed on one side or both sides of each of the first packaging foil and the second packaging foil so that the first packaging foil and the second packaging foil can be gripped.

3. The contact lens packaging container of claim 1, wherein a thickness of the body ranges from 2 to 6 mm.

* * * * *